United States Patent [19]

Villeneuve et al.

[11] Patent Number: 5,009,606

[45] Date of Patent: Apr. 23, 1991

[54] SEPARABLE ELECTRICAL CONNECTOR

[75] Inventors: Marc G. Villeneuve; William P. Buckley, both of Toronto, Canada

[73] Assignee: Burndy Corporation, Norwalk, Conn.

[21] Appl. No.: 451,796

[22] Filed: Dec. 18, 1989

[51] Int. Cl.[5] ..... H01R 13/00

[52] U.S. Cl. ..... 439/59

[58] Field of Search ..... 439/59, 60, 71

[56] References Cited

U.S. PATENT DOCUMENTS

| | | | |
|---|---|---|---|
| 3,591,834 | 7/1971 | Kolias | 439/59 |
| 3,670,290 | 6/1972 | Angele et al. . | |
| 3,685,001 | 8/1972 | Krafthefer . | |
| 3,873,173 | 3/1975 | Anhalt | 439/71 |
| 3,940,786 | 2/1976 | Scheingold et al. | 439/71 |
| 4,062,610 | 12/1977 | Doty et al. . | |
| 4,142,226 | 2/1979 | Mears | 439/59 |
| 4,385,795 | 5/1983 | Endoh et al. . | |
| 4,422,703 | 12/1983 | Christensen et al. . | |
| 4,478,742 | 10/1984 | Baar . | |
| 4,585,285 | 4/1986 | Martens . | |
| 4,715,820 | 12/1987 | Andrews, Jr. et al. . | |

*Primary Examiner*—Joseph H. McGlynn

*Attorney, Agent, or Firm*—Mitchell B. Wasson; Martin P. Hoffman; Burtsell Kearns

[57] ABSTRACT

An electrical connector characterized by a receptacle containing a plurality of female contacts having redundant contact portions and wiping capabilities with respect to male pins adapted to be inserted into the receptacle. Depending contact portions on the female contacts allow th receptacle to be separably electrically connected to a printed circuit board.

19 Claims, 2 Drawing Sheets

SEPARABLE ELECTRICAL CONNECTOR

BACKGROUND OF THE INVENTION

1. Field of the Invention

The invention pertains generally to electrical connectors. More specifically, the invention relates to an electrical connector for electrical association with a printed circuit board. The connector includes a unique receptacle containing a plurality of dual-in-line female contacts which perform both wipe and contact functions with respect to the male pin contacts of a plug member adapted to be mated with the receptacle. The connector is further provided with separable contact points for establishing electrical communication with a printed circuit board by means of standard plated through holes or solder pads provided on the printed circuit board.

The invention possesses numerous benefits and advantages over known electrical connectors. In particular, the invention utilizes a reliable gas tight separable contact principle between the receptacle and the printed circuit board which allows the number of through holes in the printed circuit board to be reduced, thereby affording component placement flexibility as well as user cost reductions. Moreover, the separable connector does not require hole masking for the connector pads on the printed circuit board and, therefore, diminishes assembly labor requirements and its associated costs. Because of its flexibility and simplicity in use and installation, the electrical connector of the instant invention realizes a reduction in tooling costs and in the costs of ongoing maintenance.

A practical example of the flexibility possessed by the invention resides in its ability to allow both it and a conventional compliant pin connector to be mounted on a single printed circuit board. For instance, user specifications may demand that electrical connectors be positioned on both sides of a double-sided printed circuit board. Generally speaking, a first side of the board will contain conventional wave solderable compliant pin connectors, which are characterized by high assembly costs. In order to minimize additional assembly costs, the second side of the printed circuit board must receive a non-solderable type connector, the latter being characterized by relatively lower costs of installation. The connector of the present invention, given its separable contact principle between the connector and the printed circuit board, is ideally suited for the preceding application, as well as other applications wherein flexibility and economy is desired.

In addition to the foregoing attributes, the electrical connector possesses numerous other electrical and mechanical benefits over conventional devices. Electrical features of the connector include improved rise times and lower drive capacitance as opposed to those for typical compliant pin connectors. Furthermore, RF radiation concerns attendant to compliant pin connectors are eliminated with the present invention.

Similarly, the mechanical features of the electrical connector enable it to tolerate more pin insertion/withdrawal cycles than conventional compliant pin devices and, as previously discussed, liberate it from the specialized installation and maintenance protocols required for conventional electrical connectors.

It can thus be seen that the present invention provides a novel electrical connector which successfully integrates a dual-in-line contact principle, which performs wipe and contact functions between the socket contact and the inserted pin, and which utilizes a GTH separable contact principle between the connector and the associated printed circuit board. 2. Description of the Prior Art It is known in the prior art to provide a dual-in-line electrical connector including a receptacle which contains socket contacts and which is mounted for electrical communication on a printed circuit board. U.S. Pat. No. 4,478,472, which issued to Baar on Oct. 23, 1984, for example, discloses an electrical connector comprising a receptacle containing a plurality of resilient contact elements. The socket contacts are provided with stems for mounting the receptacle on a printed circuit board.

The prior art also generally discloses various means and methods by which the socket contacts of a receptacle of an electrical connector are engaged on a printed circuit board utilizing a compliant pin principle. For instance, U.S. Pat. No. 4,585,285 to Martens, which was patented on Apr. 29, 1986, shows a multi-row press fit connector wherein a plurality of contacts reside in the connector body and extend therethrough, whereby a compliant end of the contacts may be press fit into a printed circuit board.

Similarly, U.S. Pat. No. 4,715,820 to Andrews, Jr. et.al., dated Dec. 29, 1987, teaches a connector having contacts which are provided with depending pins for insertion into holes formed in a printed circuit board.

U.S. Pat. No. 3,685,001, which issued to Krafthefer on Aug. 1, 1972, discloses an electrical connector characterized by a receptacle wherein depending tail members of the contacts disposed therein are adapted to be passed through a printed circuit board and are soldered in place. U.S. Pat. No. 4,385,795 to Endoh et.al., dated May 31, 1983, shows a similar arrangement.

The electrical connector of U.S. Pat. No. 3,670,290, which issued on June 13, 1974 to Anoele et.al. teaches a receptacle containing contacts which have extending portions for soldering to a printed circuit board.

Christensen et.al. bearing U.S. Pat. No. 4,422,703 and Dec. 27, 1983, disclose a receptacle wherein the contact members are provided with a bent leg for wave soldering onto a conductive strip of a printed circuit board.

Finally, the prior art discloses a socket contact member which is capable of performing a wiping and a contact action. The latter principle is broadly referred to in U.S. Pat. No. 4,062,610 of Dec. 13, 1977 to Doty et.al. As shown therein, two surfaces on the contact perform a wiping action when such surfaces come into contact with an inserted post.

It is apparent from the foregoing that the prior art fails to teach, or even suggest, an electrical connector possessing a dual-in-line contact feature which performs wiping and contact functions on an inserted pin, and a separable gas tight contact feature between the connector and a printed circuit board.

SUMMARY OF THE INVENTION

The invention pertains to an electrical connector including a receptacle body which is provided with a plurality of passageways extending from the top wall of the body through the bottom wall of the body. A dual-in-line contact member is disposed in each of the passageways. Each of the contact members has a first convex portion and a second convex portion facing toward the interior of the passageway in a pin facing direction, as well as a depending contact leg portion which projects through the bottom wall of the passageway and extends in a pin opposing direction.

The receptacle is adapted to receive corresponding male pin contacts or posts of a plug member, such that a pin contact is inserted into each of the passageways of the receptacle. The first and second convex portions of the contact members provide first and second contact points for the inserted pin, and perform wiping functions with respect to the pin.

The receptacle is adapted to be separably mounted in electrical communication on a printed circuit board by means of the contact legs contacting a conductive strip on the printed circuit board. The contacts are adapted to be associated with through holes and/or solder pads provided on the printed circuit board. The contacts utilize soft metals at high contact pressures so that, upon mating of the contacts, the metal is upset and the resultant joint prevents contamination gases from entering the contact area.

DESCRIPTION OF THE PREFERRED EMBODIMENT

Figure 1:
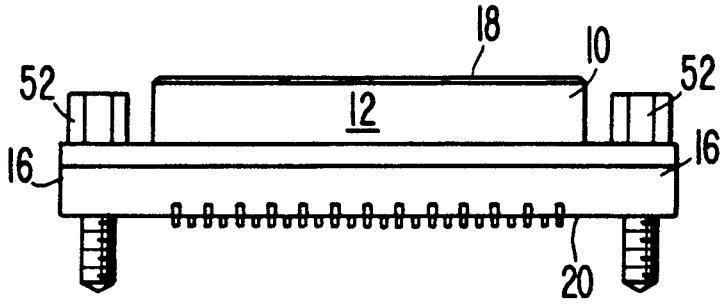
FIG. 1 is a front plan view of the connector of the present invention.
Figure 2:
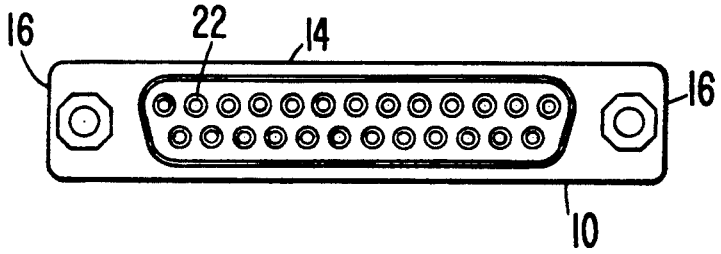
FIG. 2 is a top plan view of the connector of the present invention.
Figure 3:
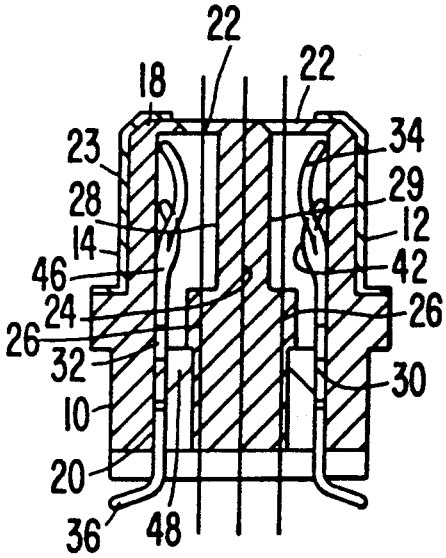
FIG. 3 is a side cross-sectional view of the connector taken through line A—A of FIG. 2.

With reference to the drawings and, in particular, with reference to FIGS. 1–3, the electrical connector comprises a receptacle body, indicated generally at 10, fabricated as an integral molding of an insulative material, preferably a glass-filled polyester material. The body is defined by a front wall 12, a rear wall 14, a pair of end walls 16, a top wall 18, and a bottom wall 20. A plurality of spaced apertures or passageways 22 are provided in the body, extending in the body through the top wall, to and through the bottom wall of the body, as most clearly shown in FIG. 3. A metal shell 23, preferably fabricated of steel, encompasses the upper portion of the body.

As depicted in FIG. 3, the passageways are oriented in the body to form two parallel rows of spaced passageways. The rows, as further shown in FIG. 2, are staggered with respect to each other. With further reference to FIG. 3, the two rows of passageways are separated by a central wall 24 of the receptacle body. A projecting shoulder 26 is formed on each of the sides 28, 29, of the central wall so as to project into each of the passageways.

Figure 4:
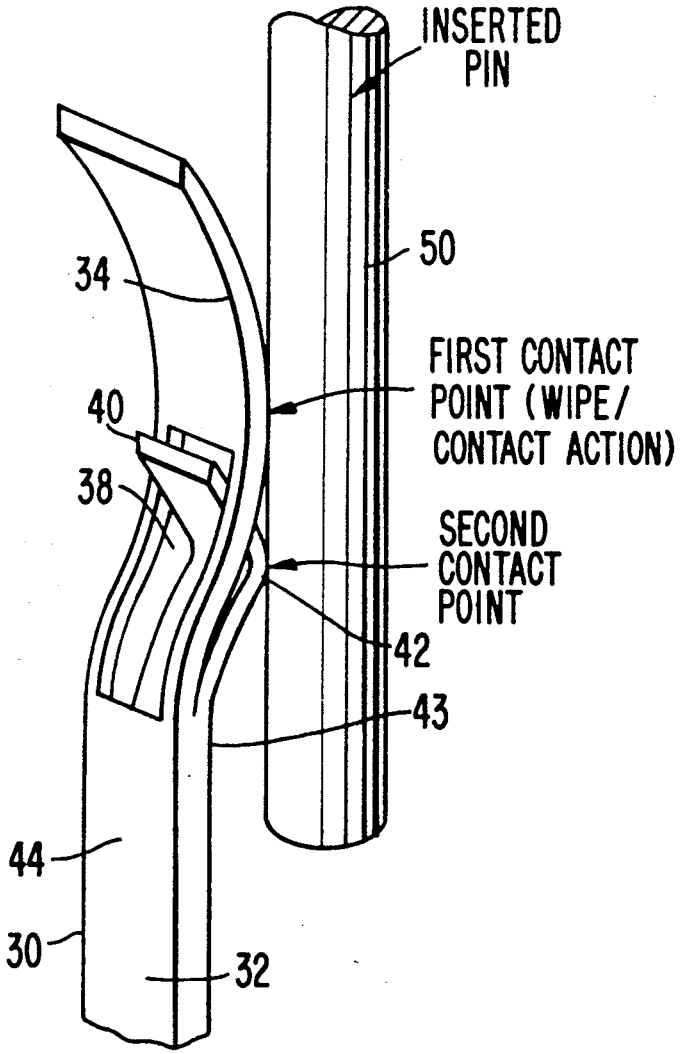
FIG. 4 is an enlarged fragmentary view of the socket contact of the connector as it appears when engaging a pin contact inserted into the connector.

As particularly shown in FIG. 3, a contact member 30 is disposed in each of the passageways 22. The contact members 30, which are of the dual-in-line type, are each formed from a blank of electrically conductive material. Each of the contact members is defined by a generally flat shank portion 32, the first end of which terminates in a first convex portion 34, and the second end of which terminates in a bent depending leg 36. First convex portion 34 is provided with a cut-out 38, through which projects the terminal end 40 of a second convex portion 42 which extends from the first end of the shank. As shown in FIGS. 3 and 4, both the first and second convex portions are disposed on what may be called the pin facing side 43 of the contact.

FIG. 3 depicts the contact members 30 as they appear when disposed within the passageways provided in the receptacle body. Thus, it can be seen that the pin facing side 43 and, hence, the convex portions 34 and 42, face the interior of the passageway, while the pin opposing side 44 of the contact member faces and substantially abuts the interior surface 46 of the front or rear wall of the receptacle body. Each of the contact members is retained in position within its respective passageway by means of a projection 48 provided on the contact member on its pin facing side engaging beneath the shoulder 26 on the central wall of the receptacle body. When so disposed in a passageway 22, the depending leg 36 of the contact member projects through the passageway at the bottom wall 20 of the receptacle body so as to extend toward the front or rear walls of the receptacle.

The electrical connector as so described is adapted to mate with a plug member (not shown) containing a plurality of male pin or post contacts to which a cable is electrically connected. A typical male pin 50 of such a plug member is illustrated in FIG. 4, which depicts the pin contact as it appears in relation to the female contact member 30 when the pin is inserted into a passageway 22 of the receptacle. As illustrated therein, the first and second convex portions of the female contact provide first and second contact points for the pin member, as well as first and second wiping action points for the male pin, thereby providing redundancy and ensuring a controlled wipe-contact sequence. Full insertion of the pin contact is achieved when the tip of the pin contact abuts the projection 48 on the contact member.

The receptacle, in turn, is intended to be separably mounted on a printed circuit board by means of the legs 36 of the contact members contacting a conductive strip on the printed circuit board under a gas tight contact principle. For this reason, the legs 36 are provided with a non-gold plating, preferably comprising 200 micro inches of tin-lead, by means of which the legs 36 function as gas tight contacts and may be brought into electrical contact with the printed circuit board. Upon mating of the contacts at high contact pressures, the soft metals are upset and the resulting joint prevents contamination gases from entering the contact area. The receptacle is adapted to accommodate both standard plated through holes in a printed circuit board, as well as solder pads with no through holes.

Figure 5:
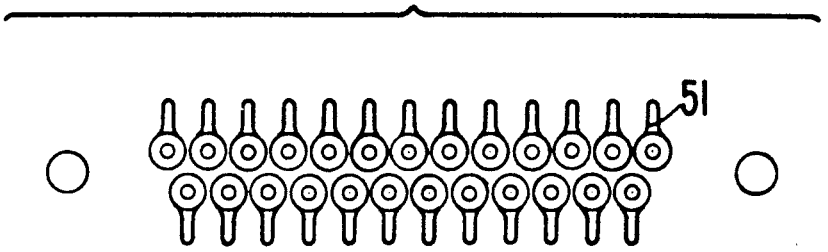
FIG. 5 is a plan view of a typical board hole and solder pad configuration for a printed circuit board to be utilized with the electrical connector.

FIG. 5 illustrates a board hole and solder pad configuration for the electrical connector, wherein it can be seen that the extended solder pads 51 provide the flexibility of accommodating the separable connector, as well a a conventional compliant pin connector. As previously discussed, however, the contact legs of the electrical connector of the invention are adapted to be associated with solder pads without any holes and without a pad extension.

In order to secure the electrical connector with respect to the associated printed circuit board, the receptacle body is provided proximate the end walls 16 with a jack screw 52. Each of the jack screws passes through the body, and is adapted to be inserted into a corresponding hole in the printed circuit board.

The present invention, therefore, provides an electrical connector in the form of a receptacle containing a plurality of dual-in-line female contact members which are provided with two contact portions for electrically engaging a male pin contact and for performing a wiping function with respect to the pin, and having gas tight contact means for separably connecting the connector to a printed circuit board.

Although the invention has been described in connection with a preferred embodiment, it should be understood that various modifications, additions and alterations may be made to the invention by one skilled in the art without departing from the spirit and scope of the invention as defined in the appended claims.

What is claimed is:

1. An electrical connector for electrical mating with a plug member having a plurality of male contact members and for electrical mounting on a printed circuit board, said electrical connector comprising a receptacle body, said body being defined by front and rear walls, a pair of end walls, a bottom wall and a top wall, a plurality of spaced passageways formed in said body and extending through said body from said top wall to said bottom wall, a single contact member received within each of said passageways, each of said contact members having a contact surface provided within its respective passageway, a depending gas tight contact portion provided on each of said contact members, said gas tight contact portions extending through said bottom wall of each passageway of said receptacle body and depending therefrom, said receptacle being adapted for electrical mating with said plug member by insertion of each of said male contact members into a respective one of said passageways, such that said contact surface electrically contacts said male contact member, said receptacle being adapted to be separably mounted on a printed circuit board by said contact portions contacting a conductive strip on said printed circuit board.

2. The electrical connector recited in claim 1 wherein said contact portions are adapted to be associated with a printed circuit board having plated through holes corresponding to said contact portions.

3. The electrical connector recited in claim 1 wherein said contact portions are adapted to be associated with a printed circuit board having solder pads corresponding to said contact portions.

4. The electrical connector recited in claim 1 wherein said body is fabricated from an insulative material.

5. The electrical connector recited in claim 1 wherein said passageways are oriented in said body in two parallel rows.

6. The electrical connector recited in claim 5 wherein said passageways of one row are staggered with respect to said passageways of the other row.

7. The electrical connector recited in claim 5 wherein said rows are separated from each other by a central wall in said body.

8. The electrical connector recited in claim 1 wherein said contact surface is provided with two contact points, each of said contact points electrically contacting said male contact member when said male contact member is inserted into said passageway.

9. The electrical connector recited in claim 8 wherein said contact points perform a wiping action with respect to said male contact member when said male contact member is inserted into said passageway.

10. The electrical connector recited in claim 1 wherein said contact portions are provided with a tin-lead plating.

11. The electrical connector recited in claim 10 wherein said contact portions are associated with said printed circuit board at high pressures to form a gas tight joint.

12. An electrical connector for electrical mating with a plug member having a plurality of male contact members and for electrical mounting on a printed circuit board, said electrical connector comprising an insulative receptacle body being defined by front and rear walls, a pair of end walls, a bottom wall and a top wall, a plurality of spaced passageways formed in said body and extending through said body from said top wall to said bottom wall, a shoulder member projecting from a portion of said body into each of said passageways, a single contact member received within each of said passageways, each of said contact members having a contact surface provided within its respective passageway, first and second contact points provided on said contact surface, a projection provided on each of said contact members for engaging said shoulder in said respective passageway for retaining said contact members in said passageways, a depending contact portion provided on each of said contact members, said contact portions extending through said bottom wall of each passageway of said receptacle body and depending therefrom, said receptacle being adapted for electrical mating with said plug member by insertion of each of said male contact members into a respective one of said passageways, such that said first and second contact points electrically contact and wipe said male contact member, said receptacle being adapted to be separably mounted on said printed circuit board by said contact portions contacting a conductive strip on said printed circuit board.

13. The electrical connector recited in claim 12 wherein said body is provided with a metal shell, said metal shell encompassing the upper portion of said body.

14. The electrical connector recited in claim 12 wherein said contact portions are adapted to be associated with a printed circuit board having plated through holes corresponding to said contact portions.

15. The electrical connector recited in claim 12 wherein said contact portions are adapted to be associated with a printed circuit board having solder pads corresponding to said contact portions.

16. The electrical connector recited in claim 12 wherein said passageways are oriented in said body in two parallel rows.

17. The electrical connector recited in claim 16 wherein said passageways of one row are staggered with respect to said passageways of the other row.

18. The electrical connector recited in claim 16 wherein said rows are separated from each other by a central wall in said body.

19. The electrical connector recited in claim 18 wherein said shoulders project from said central wall.

* * * * *